US008181939B2

(12) United States Patent
Yoon

(10) Patent No.: US 8,181,939 B2
(45) Date of Patent: May 22, 2012

(54) CONTINUOUS DRAIN-TYPE DEHUMIDIFIER

(75) Inventor: Hee-Jong Yoon, Kyunggi-do (KR)

(73) Assignee: Winix Inc. (KR)

( * ) Notice: Subject to any disclaimer, the term of this patent is extended or adjusted under 35 U.S.C. 154(b) by 346 days.

(21) Appl. No.: 12/506,380

(22) Filed: Jul. 21, 2009

(65) Prior Publication Data

US 2011/0016904 A1 Jan. 27, 2011

(51) Int. Cl.
*B01F 3/04* (2006.01)

(52) U.S. Cl. ..... 261/30; 261/DIG. 65

(58) Field of Classification Search ..... 261/30, 261/DIG. 65

See application file for complete search history.

(56) References Cited

FOREIGN PATENT DOCUMENTS

JP 2003161462 A * 6/2003

* cited by examiner

*Primary Examiner* — Robert A Hopkins

(74) *Attorney, Agent, or Firm* — Schwegman, Lundberg, Woessner, P.A.

(57) ABSTRACT

A dehumidifier for continuously draining water generated by dehumidification to an external side is provided. The continuous drain-type dehumidifier includes a case having an air inlet and outlet, a dehumidifying unit that remove moisture from air introduced through the air inlet and discharges the air through the air outlet, a middle part member having a bottom portion on which water generated by the dehumidifying unit is dropped and provided with a water outlet, and a water leakage preventing unit that is provided on the water outlet to prevent the water from leaking. The water leakage preventing unit includes a drain nipple cap inserted into the water outlet, a drain nipple snap-fitted to the drain nipple cap, and a ring compressed between the drain nipple cap and the drain nipple and close-contacting an outer circumference of the water outlet.

5 Claims, 4 Drawing Sheets

CONTINUOUS DRAIN-TYPE DEHUMIDIFIER

BACKGROUND OF THE INVENTION (a) Field of the Invention

The present invention relates to a continuous drain-type dehumidifier. More particularly, the present invention relates to a dehumidifier that can continuously drain water generated by dehumidification without storing the water in a water tank.

(b) Description of the Related Art

A typical dehumidifier is an appliance for removing moisture from indoor air. There are various dehumidifiers using different dehumidifying methods.

Among the dehumidifiers, a cooling-type dehumidifier using a cooling cycle in which moisture is removed from the air by condensing the moisture contained in the air when the air passes through a vaporizer.

The dehumidifier includes a case defining an appearance of the dehumidifier and provided with an air inlet, an intake fan that is installed in the case to suck external air, a dehumidifying unit that removes moisture from the air sucked by the intake fan by condensing the moisture contained in the air, and a water tank for storing the water generated by the dehumidification of the dehumidifying unit.

The dehumidifying unit includes a compressor for compressing a gaseous refrigerant into a high temperature/pressure state, a condenser for condensing the high temperature/pressure gaseous refrigerant, and a vaporizer for vaporizing the refrigerant that is reduced in pressure while passing through an expansion tube via the condenser.

The refrigerant circulates through the humidifier. That is, the refrigerant is directed to the vaporizer through the compressor and returned to the vaporizer via the condenser and expansion tube. At this point, when the air is sucked into the case by the rotation of the fan, the sucked air is cooled down to or below the dew point while passing through the vaporizer and condensed. Therefore, the moisture contained in the air is removed by being changed into dewdrops.

The dewdrops are directed into the water tank and stored as water. When the water tank is fully filled with the water, the water tank should be emptied.

In order to empty the water tank filled with the water, the water tank installed in the humidifier is separated from the case and the water filled in the water tank is drained out of the water tank. Alternatively, a drain pump installed outside or inside the dehumidifier may be used to discharge the water out of the water tank.

The above-described water discharging methods are a manual discharging method where the user empties the water tank by himself/herself and an automatic discharging method using the drain pump. Therefore, when the manual discharging method is used, the user may feel inconvenience in use. When the automatic discharging method is used, the user may face restriction on a using place of the humidifier.

That is, when the humidifier employing the manual discharging method is used, the user must periodically empty the water tank. This is troublesome for the user. When the humidifier employing the automatic discharging method, a discharge pipeline must be installed and thus the user may face the restriction on the using place of the humidifier.

Due to the above-described limitations, a method for continuously drain the water generated in the dehumidifier has been researched and developed.

For example, a method for directly discharging the water generated by the dehumidifying unit out of the dehumidifier using a hose has been used.

This method has a limitation in that, since dust and/or bacteria are sucked together with the indoor air into the humidifier, the water that is substantially discharged from the dehumidifier is unsanitary.

Therefore, if the water from the dehumidifier leaks during the discharging process, the indoor place may be contaminated.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a continuous drain-type dehumidifier having advantages of continuously draining water generated by dehumidification without contaminating an indoor place.

According to one exemplary embodiment, a continuous drain-type dehumidifier includes: a case having an air inlet and outlet; a dehumidifying unit that removes moisture from air introduced through the air inlet and discharges the air through the air outlet; a middle part member having a bottom portion on which water generated by the dehumidifying unit is dropped and provided with a water outlet; and a water leakage preventing unit that is provided on the water outlet to prevent the water from leaking. The water leakage preventing unit includes a drain nipple cap inserted into the water outlet, a drain nipple snap-fitted to the drain nipple cap, and a ring compressed between the drain nipple cap and the drain nipple and close-contacting an outer circumference of the water outlet.

According to the exemplary embodiment, since the ring is compressed and fixed between the drain nipple cap coupled to the water outlet and the drain nipple, leakage that may occur at a coupling portion of the water outlet side can be prevented.

Further, since the packing is interposed between the connector and the drain nipple, the water leakage between the drain nipple and the connector can be prevented.

DETAILED DESCRIPTION OF THE EMBODIMENTS

Reference will now be made in detail to the embodiments of the present disclosure, examples of which are illustrated in the accompanying drawings.

Figure 1:
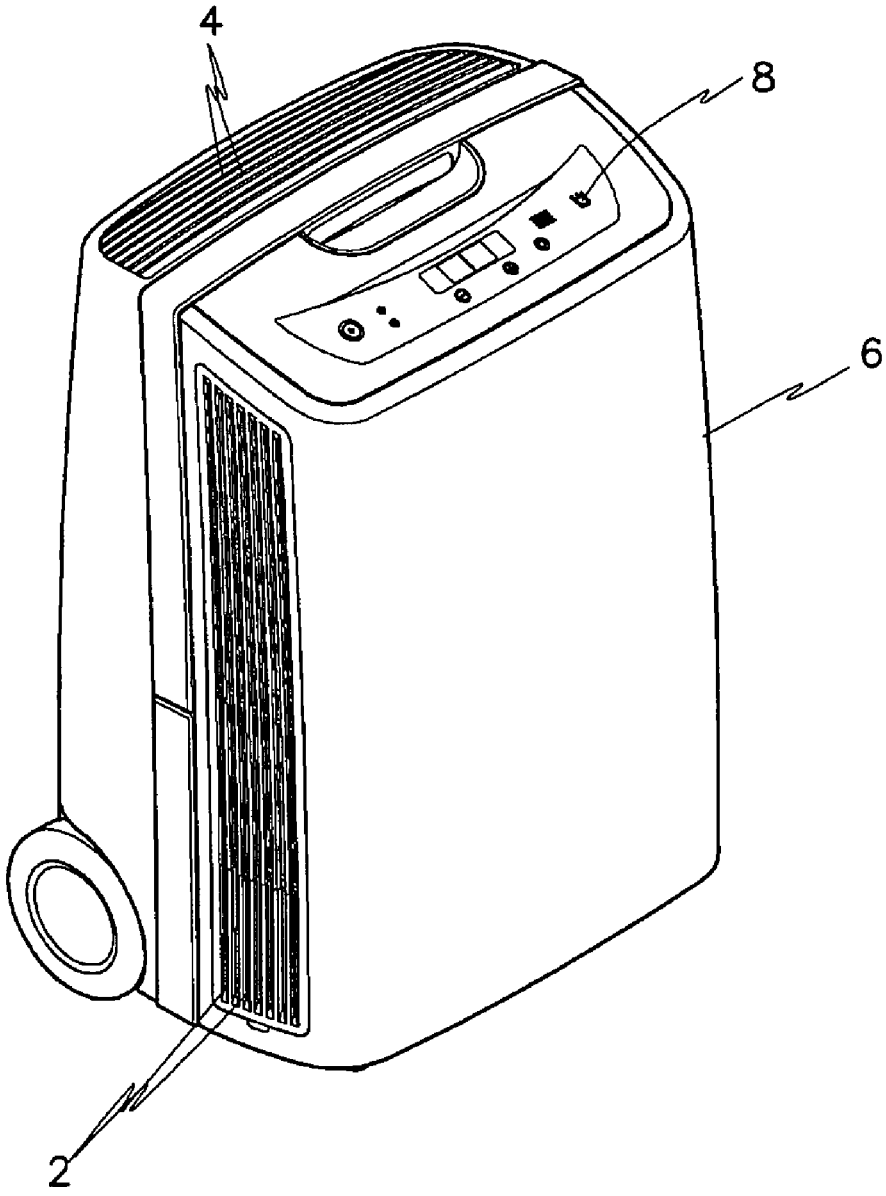
FIG. 1 is a perspective view of a dehumidifier according to an exemplary embodiment.
Figure 2:
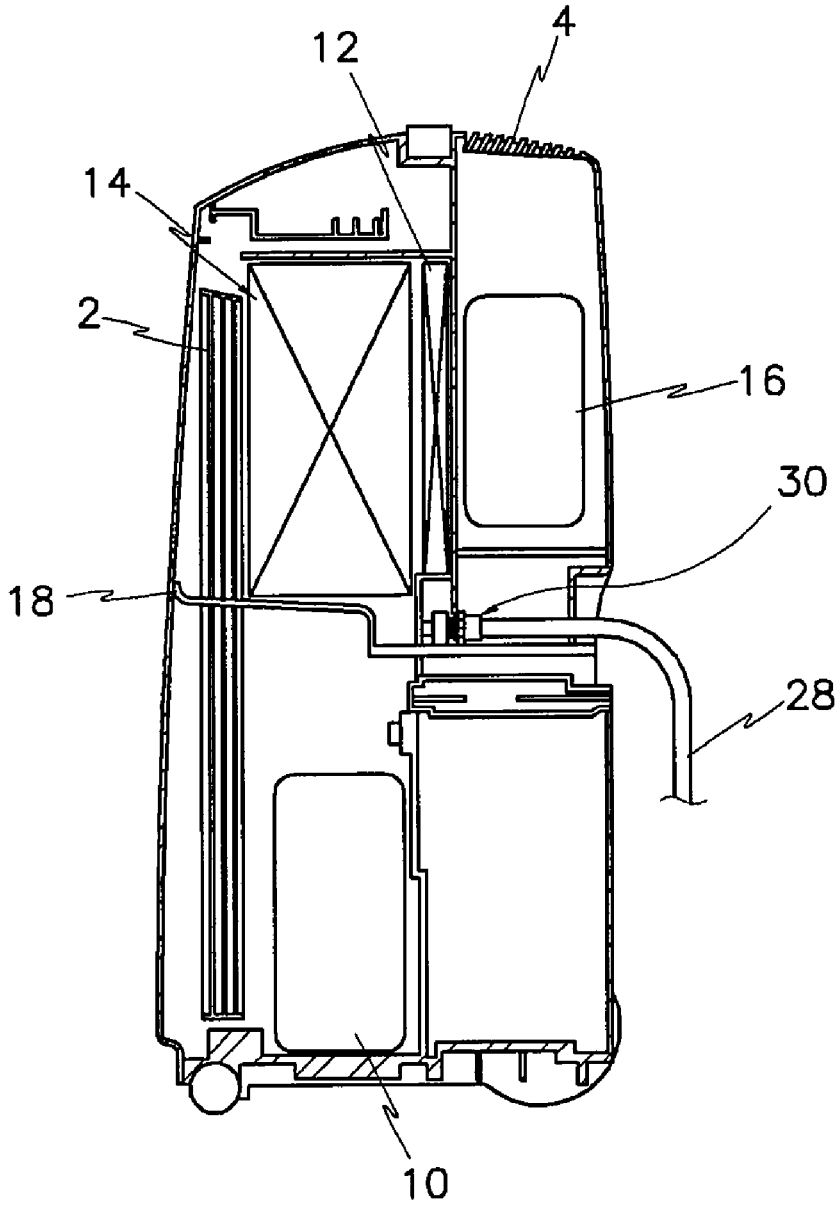
FIG. 2 is a cross-sectional side view of the dehumidifier of FIG. 1.

FIG. 1 is a perspective view of a dehumidifier according to an exemplary embodiment, and FIG. 2 is a cross-sectional side view of the dehumidifier of FIG. 1.

A humidifier includes a case 6 provided with an air inlet 2 and an air outlet 4, and a control panel 8 provided at an upper side of the case 6.

A dehumidifying unit is provided in the case 6. The dehumidifying unit includes a compressor 10 for compressing a gaseous refrigerant into a high temperature/pressure state, a condenser 12 for condensing the high temperature/pressure gaseous refrigerant from the compressor 10, and a vaporizer 14 for vaporizing the refrigerant that is reduced in pressure while passing through the condenser.

The dehumidifying unit includes a sucking unit 16 that sucks air into the case 6 so that the air can pass through the vaporizer 14.

The sucking unit 16 may be an intake fan that rotates by a motor. When the intake unit operates, the air is introduced into the case 6 through the air inlet 2 and the introduced air is discharged through the air outlet 4 via the dehumidifying unit.

A lower portion of the vaporizer 14 is supported by a middle part member 18 installed in the case 6.

Figure 3:
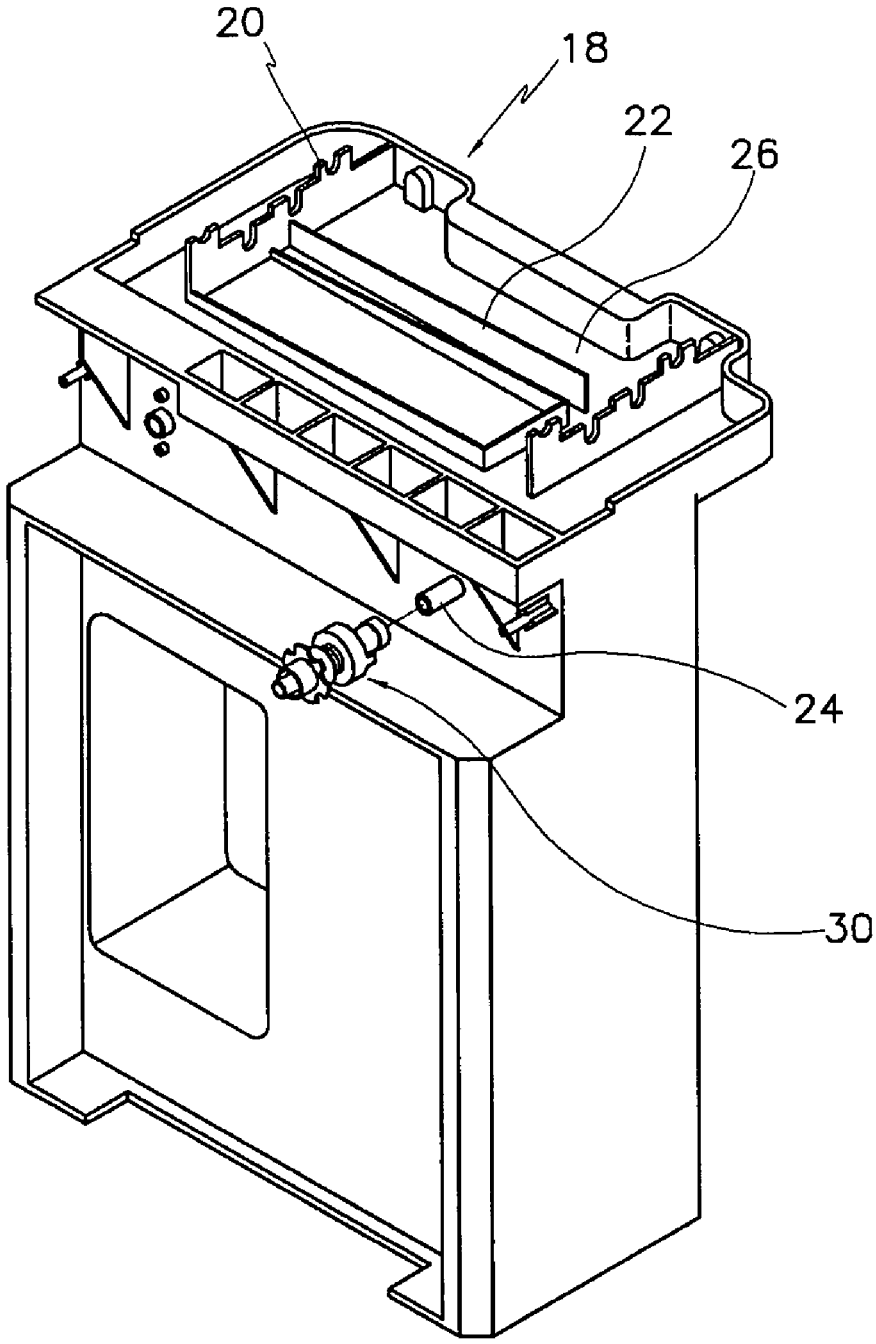
FIG. 3 is a perspective view of a middle part member of the dehumidifier of FIG. 2.

As shown in FIG. 3, the middle part member 18 includes a plurality of supports 20 supporting the vaporizer 14 and a shielding wall 22 for blocking the air that flows under the vaporizer without passing through the vaporizer 14. This is for enhancing the dehumidifying efficiency.

The middle part member 18 has a bottom portion 26 that is designed to be gradually sloped toward a water outlet so that water generated at the vaporizer 14 can be directed toward a water outlet 24.

In order to prevent the water from leaking at a connection portion of a hose 28 with the water outlet 24, a water leakage preventing unit 30 is provided between the water outlet 24 and the hose 28.

The water leakage preventing unit 30 is connected to the water outlet 24 so that the water generated at the vaporizer 14 can flow along the hose 28. The hose 28 may extend to an outdoor side or to a drain hole of a building.

Figure 4:
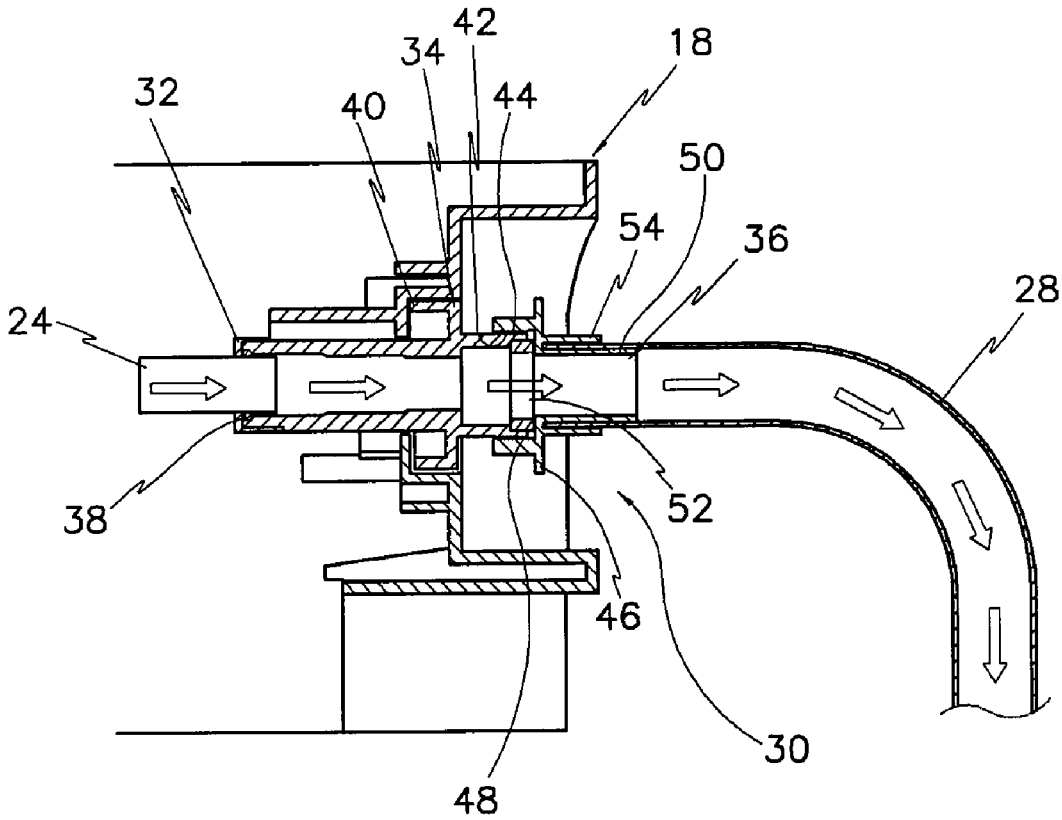
FIG. 4 is a cross-sectional side view of a leak preventing unit of the dehumidifier of FIG. 2.

As shown in FIG. 4, the water leakage preventing unit 30 includes a drain nipple cap 32 connected to the water outlet 24, a drain nipple 34 connected to the drain nipple cap 32 and fixed to the middle part member 18, and a connector 36 screw-coupled to the drain nipple 34.

The drain nipple cap 32 and the drain nipple 34 are interconnected through a snap fit. A ring 38 is provided on a coupling portion between the drain nipple cap 32 and the drain nipple 34.

The ring 38 is compressed between the drain nipple cap 32 and the drain nipple 34 to prevent the water from leaking through the coupling portion between the drain nipple cap 32 and the drain nipple 34.

To this end, the ring 38 may be formed of silicon rubber or other materials that can be elastically compressed.

The drain nipple 34 is provided with a hook 40 for fixing the drain nipple 34 to the middle part member 18. The hook 40 may be formed with a shape that is similar to a structure that is usually used as a fixing unit.

The connector 36 has a female screw portion 44 coupled to a screw portion 42 of the drain nipple 34. The female screw portion 44 is integrally formed with a flange 46.

The flange 46 has a shielding portion 48 that extends inside to contact an end portion of the screw portion 42.

The shielding portion 48 is provided at an inside thereof with an insertion portion 50 having a passage along which the water is discharged. The hose 28 is connected to the insertion portion 50.

Packing 52 is located between the shielding portion 48 and the screw portion 42. When the female screw portion 44 is screw-coupled to the screw portion 42, the packing 52 is compressed between the screw portion 42 and the female screw portion 44.

The flange 46 is provided with a hose movement preventing member 54 that is spaced outward apart from the insertion portion 50. When the hose 28 is inserted into the insertion portion 50, the hose movement preventing member 54 encloses an outer surface of the hose 28.

The dehumidifying operation of the above-described continuous drain-type dehumidifier of the present exemplary embodiment is the same as or similar to a typical dehumidifier.

However, in the dehumidifier of the present exemplary embodiment, since the shielding wall 22 protrudes from the bottom portion 26 of the middle part member 18, the air sucked by the sucking unit 16 fully passes through the vaporizer 14 during the dehumidifying operation and thus the dehumidifying efficiency can be enhanced.

The water generated by the dehumidifying unit 16 is dropped down to a top surface of the middle part member 18 below the vaporizer 14.

Since the bottom portion 26 is inclined downward toward the water outlet 24, the water that has dropped onto the top surface of the middle part member 18 flows toward the water outlet 24.

Therefore, the water generated by the dehumidification is drained along the hose 28 connected to the water outlet 24. The hose 28 may extend to an outdoor side or is connected to a building drain hole. Therefore, the water generated by the dehumidification can be continuously drained.

The continuous draining becomes possible by the water leakage preventing unit 30 of the exemplary embodiment. That is, the continuous draining becomes possible as the water leakage can be prevented at the connecting portions of the components during the draining of the water.

Particularly, according to the dehumidifier of the present exemplary embodiment, since the ring 38 is provided on the water outlet of the middle part member 18 and the drain nipple cap 32 is snap-fitted to the drain nipple 34, the ring 38 closely contacts the outer circumference of the water outlet 24 and thus the water leakage can be prevented.

Further, since the packing 52 is interposed between the connector 36 and the drain nipple 34, the water leakage between the drain nipple 34 and the connector 36 can be prevented.

In addition, since the movement of the hose 28 inserted into the insertion portion 50 of the connector 36 can be prevented by the hose movement preventing member 54, the water leakage that may occur at the hose connection portion can be prevented.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A continuous drain-type dehumidifier comprising:

a case having an air inlet and outlet;

a dehumidifying unit that removes moisture from air introduced through the air inlet and discharges the air through the air outlet;

a middle part member having a bottom portion on which water generated by the dehumidifying unit is dropped and provided with a water outlet, wherein the bottom portion of the middle part member is inclined downward toward the water outlet, and wherein the middle part member is provided at the bottom portion with a shielding wall for enhancing dehumidifying efficiency; and a water leakage preventing unit that is provided on the water outlet to prevent the water from leaking, wherein the water leakage preventing unit comprises a drain nipple cap inserted into the water outlet, a drain nipple snap-fitted to the drain nipple cap, and a ring compressed between the drain nipple cap and the drain nipple and close-contacting an outer circumference of the water outlet.

2. The continuous drain-type dehumidifier of claim 1, wherein the water leakage preventing unit comprises a connector screw-coupled to the drain nipple, and a hose for guiding discharge of the water is connected to the connector.

3. The continuous drain-type dehumidifier of claim 2, wherein the connector is coupled to the drain nipple with packing interposed therebetween, and the packing is pressed by a shielding portion formed on the connector to prevent water leakage.

4. The continuous drain-type dehumidifier of claim 3, wherein the connector has an insertion portion in which the hose is inserted, and a hose movement preventing unit that encloses an outer circumference of the hose inserted into the insertion portion is provided on an outer side of the insertion portion.

5. The continuous drain-type dehumidifier of claim 1, wherein the drain nipple is provided with a hook for fixing the drain nipple to the middle part member.

* * * * *